United States Patent [19]

Thoe

[11] Patent Number: 5,027,377

[45] Date of Patent: Jun. 25, 1991

[54] CHROMATIC X-RAY MAGNIFYING METHOD AND APPARATUS BY BRAGG REFLECTIVE PLANES ON THE SURFACE OF ABBE SPHERE

[75] Inventor: Robert S. Thoe, Livermore, Calif.

[73] Assignee: The United States of America as represented by the United States Department of Energy, Washington, D.C.

[21] Appl. No.: 462,254

[22] Filed: Jan. 9, 1990

[51] Int. Cl.[5] ..... G21K 1/00; G21K 7/00

[52] U.S. Cl. ..... 378/145; 378/84; 378/43; 378/85

[58] Field of Search ..... 378/145, 43, 85, 84

[56] References Cited

U.S. PATENT DOCUMENTS

| | | | |
|---|---|---|---|
| 2,759,106 | 8/1956 | Wolter | 250/53 |
| 4,525,853 | 6/1985 | Keem et al. | 378/84 |
| 4,941,163 | 7/1990 | Hoover | 378/84 |

OTHER PUBLICATIONS

DuMond et al, Rev. Sci. Instr. 1, pp. 88 to 105, (1930).
Johansson, Zeitschrift fur Physik 82, pp. 507 to 528 (1933).
Ehrhardt et al, Applied Spectroscopy 22, pp. 730 to 735 (1968).
Birks et al, Rev. Sci. Instr. 24, p. 992 (1953).
Kirkpatrick et al, J. Opt. Soc. Amer. 38, pp. 766 to 774 (1948).
Wolter, Annalen der Physik 10, pp. 94 to 114 (1952).
Boyle et al, Rev. Sci. Instr. 49, pp. 746 to 751 (1978).
Born et al, "Principles of Optics, Third (Revised) Edition", pp. 167 and 168, Pergamon Press (1965).

*Primary Examiner*—Edward P. Westin
*Assistant Examiner*—Kim-Kwok Chu
*Attorney, Agent, or Firm*—Henry P. Sartorio; L. E. Carnahan; William R. Moser

[57] ABSTRACT

Method and apparatus for producing sharp, chromatic, magnified images of X-ray emitting objects, are provided. The apparatus, which constitutes an X-ray microscope or telescope, comprises a connected collection of Bragg reflecting planes, comprised of either a bent crystal or a synthetic multilayer structure, disposed on and adjacent to a locus determined by a spherical surface. The individual Bragg planes are spatially oriented to Bragg reflect radiation from the object location toward the image location. This is accomplished by making the Bragg planes spatially coincident with the surfaces of either a nested series of prolate ellipsoids of revolution, or a nested series of spheres. The spacing between the Bragg reflecting planes can be tailored to control the wavelengths and the amount of the X-radiation that is Bragg reflected to form the X-ray image.

33 Claims, 7 Drawing Sheets

CHROMATIC X-RAY MAGNIFYING METHOD AND APPARATUS BY BRAGG REFLECTIVE PLANES ON THE SURFACE OF ABBE SPHERE

The U.S. Government has rights in this invention pursuant to Contract No. W-7405-ENG-48 between the U.S. Department of Energy and the University of California for the operation of the Lawrence Livermore National Laboratory.

BACKGROUND OF THE INVENTION

The invention described herein relates generally to methods and apparatus for producing magnified X-ray images of X-ray emitting objects.

J. W. M. DuMond and Harry A. Kirkpatrick, Rev. Sci. Instr. 1, 88 (1930), discuss the problem of finding the contour to which a flexible crystal surface must conform so that monochromatic X-ray radiation from a point A would be selectively focused by Bragg reflection at a point B. Bragg reflection imposes two conditions at every point on the curved crystal surface:

(1) At all points on the surface the angles of incidence and reflection, referred to the reflecting atomic planes, must be equal.

(2) At all points on the surface the angle of deviation of the reflected beam must be constant.

These two conditions dictate the position and the slope of every point on the curved surface of the flexible crystal. In the usual case, where the atomic crystal planes are locally parallel to the reflecting boundary of the crystal surface, no continuous smooth surface contour can simultaneously satisfy these two conditional parameters. However, noticing that condition (1) dictates the direction of the atomic reflecting planes but imposes no condition on the reflecting boundary of the crystal, and that condition (2) dictates the position of every point on the reflecting boundary but demands nothing of the atomic reflecting planes, the two conditional parameters can, in fact, be simultaneously satisfied by crystal configurations wherein the atomic reflecting planes are not required to be parallel to the reflecting boundary of the crystal. Dumond and Kirkpatrick then proceed to disclose that, in a cylindrical situation, by employing a crystal whose reflecting boundary coincides with part of the outer surface of a circle, and whose atomic reflecting planes are bent to coincide with concentric circles centered on a point on the circumference of the circle that is diametrically across the circle from the crystal, the two Bragg reflection focusing conditions can be simultaneously met.

Johansson, Zeitschrift fur Physik 82, 507 (1933), develops the reflecting geometry of Dumond and Kirkpartrick, which has come to be known as the Johansson curved-crystal dispersion arrangement. As a practical matter, Johansson spectrometers employ circularly cylindrical crystal surfaces and atomic reflecting bent planes, so that points are focused approximately to lines, which is ideal for X-ray line spectroscopy.

Spherically curved point-focusing Bragg monochrometers, wherein a crystal is spherically bent to a radius twice that of the focal circle and then ground so that the front surface is spherical and of the same radius as the focal circle, that are extensions of the Johansson geometry, have been discussed by Ehrhardt et al, Applied Spectroscopy 22, 730 (1968).

The crystals used by Ehrhardt et al, supra, were bent at elevated temperatures by extensions of a technique suggested by Birks et al, Rev. Sci. Instr. 24, 992 (1953), wherein an ordinary tennis ball may be used to form a flexible concave die in the bending process.

It should be noticed that the discussion has thusfar been limited to the point- or line-focusing of monochromatic, single wavelength, X-rays.

The formation of chromatic optical images by X-rays and the possibility of constructing an X-ray microscope were discussed by Paul Kirkpatrick and A. V. Baez, J. Opt. Soc. Amer. 38, 766 (1948). They point out that two internal total reflection at small grazing angles X-ray mirrors may be positioned to produce point images of point objects, and therefore real, extended images of extended objects. They suggest, without elaboration, that elliptical and parabolic surfaces will almost certainly be superior to spherical surfaces for this purpose.

Wolter, in U.S. Pat. No. 2,759,106 issued Aug. 14, 1956 and claiming priority from a German application filed May 25, 1951, discloses an X-ray optical image-forming mirror system that comprises hyperboloid and ellipsoid small grazing angle reflecting surfaces having a common axis. Wolter also, in a beautiful paper, Annalender Physik 10, 94 (1952), discusses X-ray optics closely related to his patented hyperboloid-ellipsoid system. An embodiment of this Wolter small grazing angle mirror system has been built and operated at the Lawrence Livermore National Laboratory; it is described by Boyle et al in Rev. Sci. Instr. 49, 746 (1978).

Keem et al, U.S. Pat. No. 4,525,853 issued June 25, 1985 teaches a point source non-imaging X-ray focusing device wherein the focusing element comprises the inner surface of an ellipsoid with a synthetic multilayer formed thereupon. The layer pairs of the multilayer are locally parallel to the surface boundary of the ellipsoid. The source and focus are at the foci of the ellipsoid. The synthetic multilayer coating can be thickness graded to retain reflectance over increased portions of the surface of the ellipsoid by compensating for the change in incident angle at different locations on the reflecting surface.

It is thus observed that all prior art methods and apparatus for producing magnified chromatic X-ray images of extended X-ray emitting objects, rely on and are limited to techniques that utilize small grazing angle total internal X-ray reflection.

SUMMARY OF THE INVENTION

It is, therefore, an object of this invention to provide method and apparatus for chromatic X-ray microscopy and telescopy.

Another object of this invention is to provide method and apparatus, that do not rely on internal total reflection at small grazing angle optical techniques, for chromatic X-ray microscopy and telescopy.

Yet another object of this invention is to provide method and apparatus, that do not rely on internal total reflection at small grazing angle optical techniques, for producing extended magnified chromatic X-ray images of extended X-ray emitting objects.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, both method and apparatus are disclosed for producing sharp chromatic images of magnification M, which may be greater than or less than unity, from radiation within, particularly, X-ray bandwidths, propagated from X-ray emitting objects.

The method may be used to produce a sharp chromatic X-ray image of a portion of an object plane in the neighborhood of a point A, upon the neighborhood of a point B on an image plane. A and B are conjugates, and define the system axis, to which the object and image planes are generally perpendicular. The method comprises directing X-ray, and other, radiation from the object, onto a connected collection of Bragg reflecting planes. By connected, it is meant that all the parts of the collection of Bragg reflecting planes are physically joined and related to one another. The connected Bragg planes are configured on and adjacent to a locus which is a spherical surface of radius R. R is equal to $MS/(M^2-1)$, where S is the distance between A and B and is taken as positive when M, the magnification, is greater than unity, and as negative when M is less than unity. This is necessary to insure that R is always positive. In operation, the spherical surface is centered on the system axis, A is positioned R/M from the center of the spherical surface, and B is positioned MR from the center of the spherical surface. The center of the spherical surface must not be between the points A and B, to insure that MR-R/M always equals S. The method further comprises having the Bragg reflecting planes spatially oriented to Bragg reflect the radiation propagating from the neighborhood of point A toward the neighborhood of point B.

The spatial orientation of the Bragg reflecting planes may preferably be achieved by making them, individually, either, spatially coincident with individual surfaces of the nested series of prolate ellipsoids of revolution having foci at points A and B; or, spatially coincident with individual surfaces of the nested series of spheres that are centered at the point of intersection of the spherical surface of radius R upon the system axis, lying between points A and B.

The spacing distance between adjacent Bragg reflecting planes may, preferably, either be a constant, or tailored to control the wavelengths and the amount of Bragg reflected radiation.

Preferably, the connected collection of Bragg reflecting planes may be a crystal, prepared by heating, bending, and machining. Alternatively, the connected collection of Bragg reflecting planes may be comprised of a synthetic mutilayer structure.

In a further aspect of this invention, a single sharp chromatic X-ray image, as described above, may be produced using a multiplicity of connected collections of Bragg reflecting planes, all deployed, at different locations, on and adjacent to the same locus determined by the same spherical surface of radius R, equal to $MS/(M^2-1)$. The orientations of the Bragg reflecting planes are, in each instance, as individually described above. That is, they are spatially coincident with the surfaces of either the same nested series of prolate ellipsoids of revolution, or the same nested series of spheres. However, the spacing distance between adjacent Bragg reflecting planes may be a different constant for each individual connected collection of Bragg reflecting planes. Alternatively, the spacing distance between adjacent Bragg reflecting planes may, for each individual connected collection of Bragg reflecting planes, be individually tailored to control the wavelengths and amounts of reflected radiation. And, preferably, the connected collections of Bragg reflecting planes may be comprised of crystals or synthetic multilayer structures.

The present invention also comprises X-ray microscopes and telescopes comprised of one or more connected collections of Bragg reflecting planes, as described above, and operated in accordance with the methodology described above. Multiple X-ray microscopes and/or telescopes, in accordance with this invention, may be simultaneously used in conjunction with a single X-ray emitting object, to produce multiple sharp chromatic X-ray images, at multiple spatial locations, of different magnifications, and comprised of X-rays and other radiation within different bandwidths.

It is thus clear that the benefits and advantages of this invention, as embodied and broadly described herein, include, inter alia, method and apparatus, not relying on internal total reflection at small grazing angle optical techniques, for producing sharp, extended, magnified chromatic X-ray images of extended X-ray emitting objects.

BRIEF DESCRIPTION OF THE DRAWINGS

The accompanying drawings, which are incorporated into and form a part of the specification, illustrate several embodiments of this invention and, together with the description, serve to explain the principles of the invention. In the drawings.

DETAILED DESCRIPTION OF THE INVENTION

This invention brings to light, for a flexible or otherwise conformable crystal or synthetic multilayer structure, the surface contour and the atomic or Bragg reflecting plane directional orientation upon that contour, that are physically required to focus and image X-ray radiation within a given bandwidth from an extended object upon a magnified real image. The invention discloses novel X-ray microscopes and telescopes and related methodology that function and rely on normal and near-normal incidence Bragg reflection, and which do not rely on internal total reflection at small grazing angles X-ray mirrors.

According to the very well known and highly regarded textbook "Principles of Optics, Third (Revised) Edition", by Born and Wolf, published by Pergamon Press (1965), and incorporated by reference herein, the sine condition, which was first derived by Clausius (1864) and Helmholtz (1874) and independently discovered by Abbe (1872), with whose name it is frequently associated, "is the required condition under which a small region of the object plane in the neighborhood of the axis is imaged sharply by a pencil of any angular divergence", at pages 167 and 168.

Figure 1:
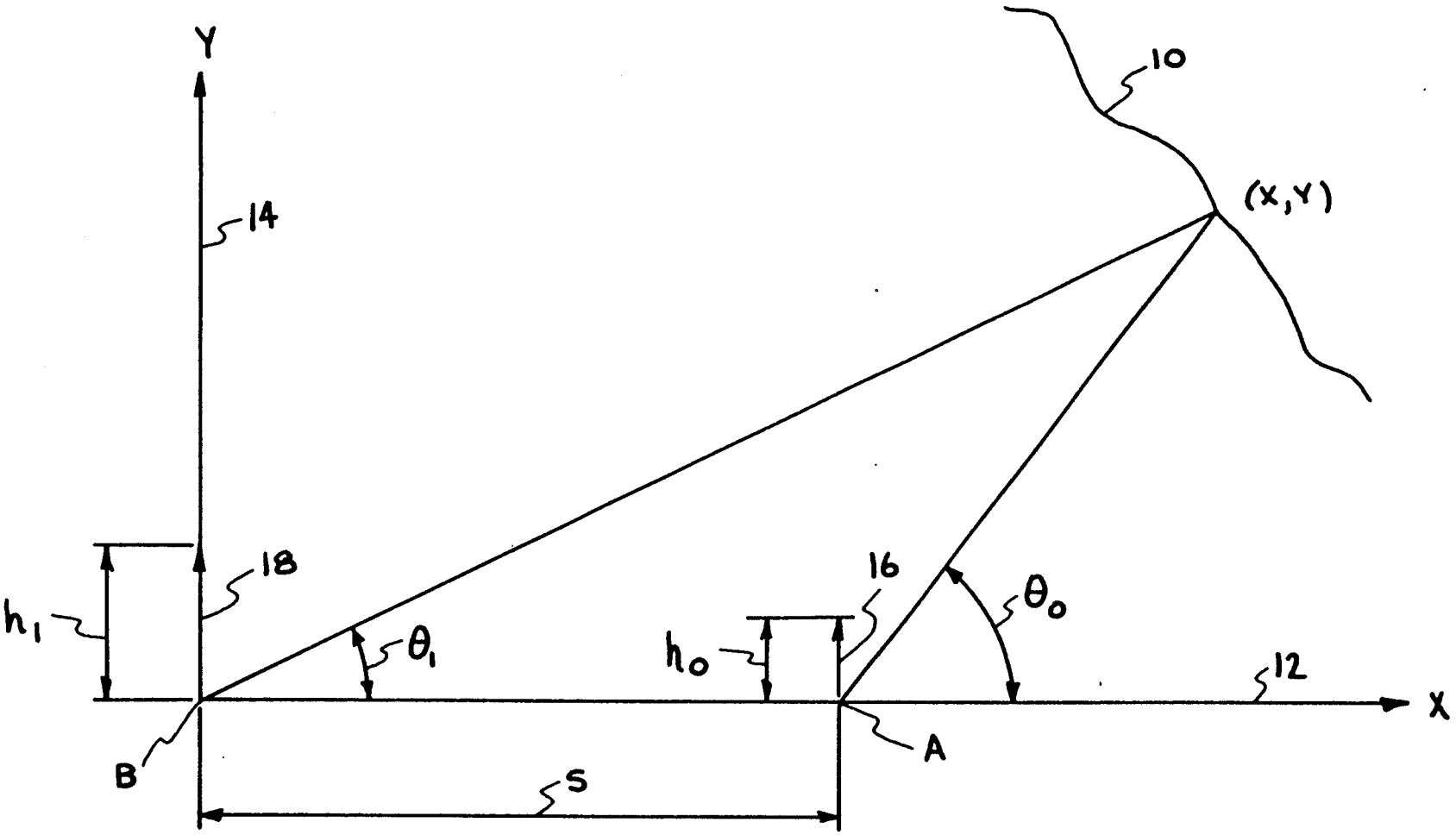
FIG. 1 is a diagram illustrating the Abbe sine condition for the case of a single reflection.

The Abbe sine condition for the case of a single reflection, with index of refraction assumed to be unity and therefore neglected, is illustrated in FIG. 1. A generalized reflecting surface 10 is shown axisymmetric about an x-axis 12. A y-axis 14 is shown but, for simplicity, a z-axis orthogonal to x-axis 12 and y-axis 14 is not shown. An object 16 of length $h_o$ is at a point A on x-axis 12, and an image 18 of length $h_I$, is shown at a point B on x-axis 12. Point B is taken as the origin of the x-y system. Points A and B are shown as separated by a length S. Since point B is a stigmatic, or sharp, image of point A, point B is a conjugate point of point A. Image 18 is formed by a single reflection from surface 10 at points represented by a point (x, y). The Abbe sine condition is assumed to be satisfied by the geometry of FIG. 1. Therefore, $$h_I \sin\theta_I = h_o \sin\theta_o. \quad (1)$$

Further, since the magnification M of image 18 is by definition $$M = h_I/h_o, \quad (2)$$

it follows immediately from equation (1) that $$My/\sqrt{x^2+y^2} = y/\sqrt{(x-S)^2+y^2}. \quad (3)$$

After some manipulation, equation (3) may be recast as $$(x-MR)^2+y^2=R^2, \quad (4)$$

where $$R=MS/(M^2-1). \quad (5)$$

This is the equation of a circle, or rather, since the systematics are axisymmetric about x-axis 12, a spherical surface of radius R that is centered on the x-axis 12 a distance MR to the right of the point B. This surface will be referred to herein as the Abbe surface, or the surface of the Abbe sphere. In equation (5) S is taken as positive when M is greater than unity and as negative when M is less than unity. Aside from the trivial situation of the plane mirror, sharp images by single reflection can only be formed by a reflection from the surface of an Abbe sphere. To continue, through the use of equation (5), it can be directly shown that $$MR-S=R/M, \quad (6)$$

with the MR−S being the distance from point A to the center of the Abbe sphere.

Figure 2:
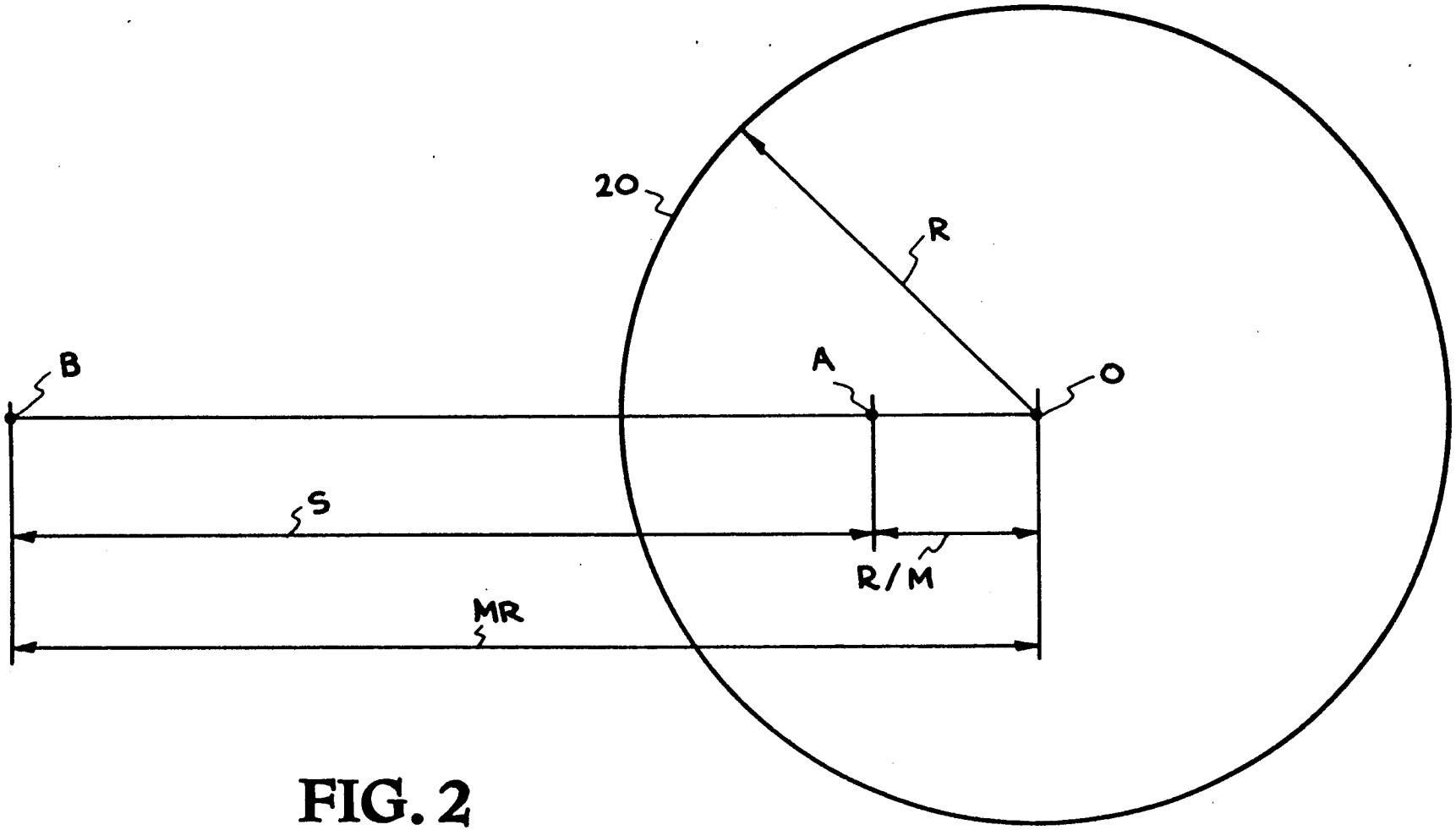
FIG. 2 is a first diagram illustrating geometry relative to an Abbe sphere, in accordance with this invention.

FIG. 2 provides a diagram illustrating the required geometry relative to an Abbe sphere 20. The points A and B remain as defined above. A point O is the center of the Abbe sphere. As an example, notice that for the case of the magnification M equaling 2.5, with the radius of the Abbe sphere, R, equaling 1.0 length unit, MR will equal 2.5 length units, R/M will equal 0.4 length units, and S will equal 2.1 length units. In going from a situation where the magnification is M to one where it is 1/M, the positions of the points A and B interchange with one another. Situations where the magnification is less than unity are included within this invention. In fact, the microscopes of this invention will usually have a magnification greater than unity, with the object being within the Abbe sphere and the image being outside the Abbe sphere, as shown in FIG. 2. On the other hand, the telescopes of this invention will usually have a magnification less than unity, with the object being outside the Abbe sphere and the image being within the Abbe sphere. Whether an apparatus in accordance with this invention is termed a microscope or a telescope, is merely a matter of semantics. It should be further noted that as an object proceeds to an infinite distance from the center of an Abbe sphere, its image proceeds toward the center of the Abbe sphere. It is observed that by fixing any two of the three quantities M, R and S, all the relationships of FIG. 2 are thereby determined. Specifically, if M and R are given, then $$S=[(M^2-1)/M]R \quad (7)$$

with MR and R/M readily determinable. If M and S are given, then R is given by equation (5) with MR and R/M readily determinable. And, if R and S are given, then $$M = S/2R + \sqrt{(S^2/4R^2)+1} \quad (8)$$

with MR and R/M readily determinable. It is extremely important to observe that for any fixed R, all magnifications are possible simply by moving both the points A and B to appropriate new locations, as determined by R/M and MR, respectively. This fact makes it possible to construct a single piece of apparatus, in accordance with this invention, contoured to a single Abbe sphere, by means of which it will be possible to produce X-ray images of a wide variety of different magnifications.

Again with reference to FIG. 2, and as a direct consequence of the sine condition, for a region of an object plane in the neighborhood of the point A to be sharply imaged in the neighborhood of the point B, radiation must propagate from point A to the surface of the Abbe sphere 20, reflect, and propagate to the point B. A glance at the Figure shows that a reflection behavior other than that wherein the angles of incidence and reflection, referred to the surface normal, are equal, will be required for the novel X-ray microscopes and telescopes of this invention.

Figure 3:
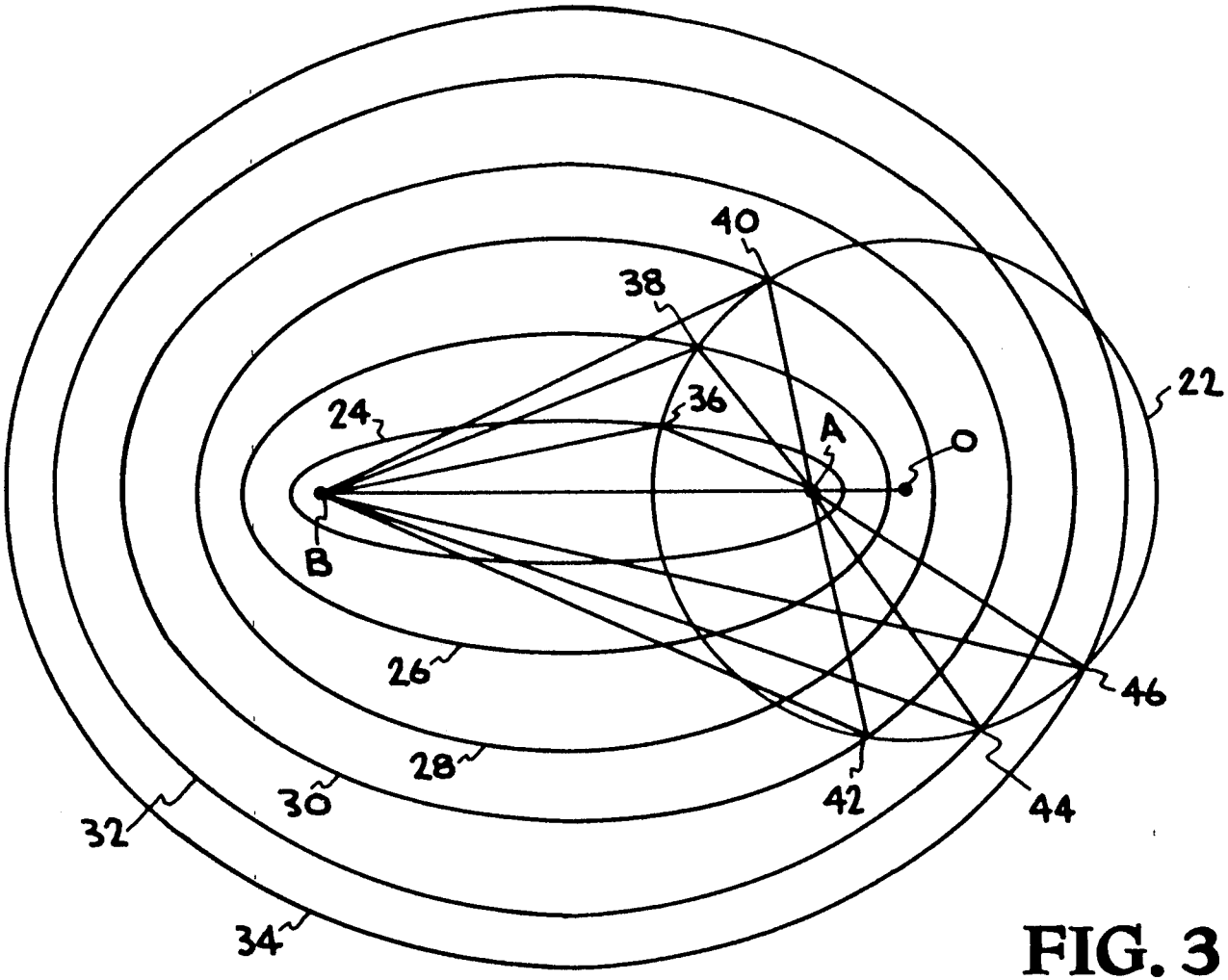
FIG. 3 is a second diagram illustrating geometry relative to an Abbe sphere, and a nested series of prolate ellipsoids of revolution, in accordance with this invention.

Since the two lines joining the foci of any ellipse to any point on the ellipse make equal angles with the tangent to the ellipse at that point, connected collections of Bragg reflecting planes disposed on and nearly adjacent to the surface of an Abbe sphere, and having their Bragg reflecting planes, individually, spatially coincident with the surfaces of individual prolate ellipsoids of revolution that commonly have their foci at the object and image points, A and B, may be used in constructing X-ray microscopes and telescopes in accordance with this invention. This is explained by reference to FIG. 3. A surface of an Abbe sphere 22 centered at point O, and an object point A and an image point B, all as spatially related and defined hereinabove, are shown. A nested series of prolate ellipsoids of revolution 24, 26, 28, 30, 32, and 34, all having their foci at the points A and B, are also shown. A prolate ellipsoid, sometimes called a prolate spheroid, of revolution is obtained by revolving an ellipse about its major axis. The equation, in three-space, of a prolate ellipsoid of revolution is $$x^2/a^2+y^2/(a^2-c^2)+z^2/(a^2-c^2)=1, \quad (9)$$

where $2a$ is the length of the major axis, and $2c$ is the distance between foci. Consequently, the three-dimensional ellipsoids of revolution 24, 26, 28, 30, 32 and 34 of FIG. 3, where the distance between the points A and B is S, as discussed and defined above, may be represented by the parametric equation $$x^2/a^2+4y^2/(4a^2-S^2)+4z^2/(4a^2-S^2)=1, \quad (10)$$

where the parameter a has any value greater than S/2. Thus, for any given pair of foci, such as the points A and B, there is but a single set of nested prolate ellipsoids of revolution, which may be expressed through the parameter a. Lines or rays extending from the point A to the points 36, 38, 40, 42, 44 and 46, which are, respectively, at points of intersection of the prolate ellipsoids of revolution 24, 26, 28, 30, 32 and 34, with the surface of the Abbe sphere 22, and extending thence to the point B, all, as shown, have equal angles of incidence and reflection upon the surface of the prolate ellipsoid of revolution which they strike. At the points 36, 38 and 40 these lines or rays, as just described, pass through the surface of the Abbe sphere 22. At the points 42, 44 and 46 these lines or rays do not pass through the surface of the Abbe sphere. Both of these situations are included within the scope of this invention.

Figure 4:
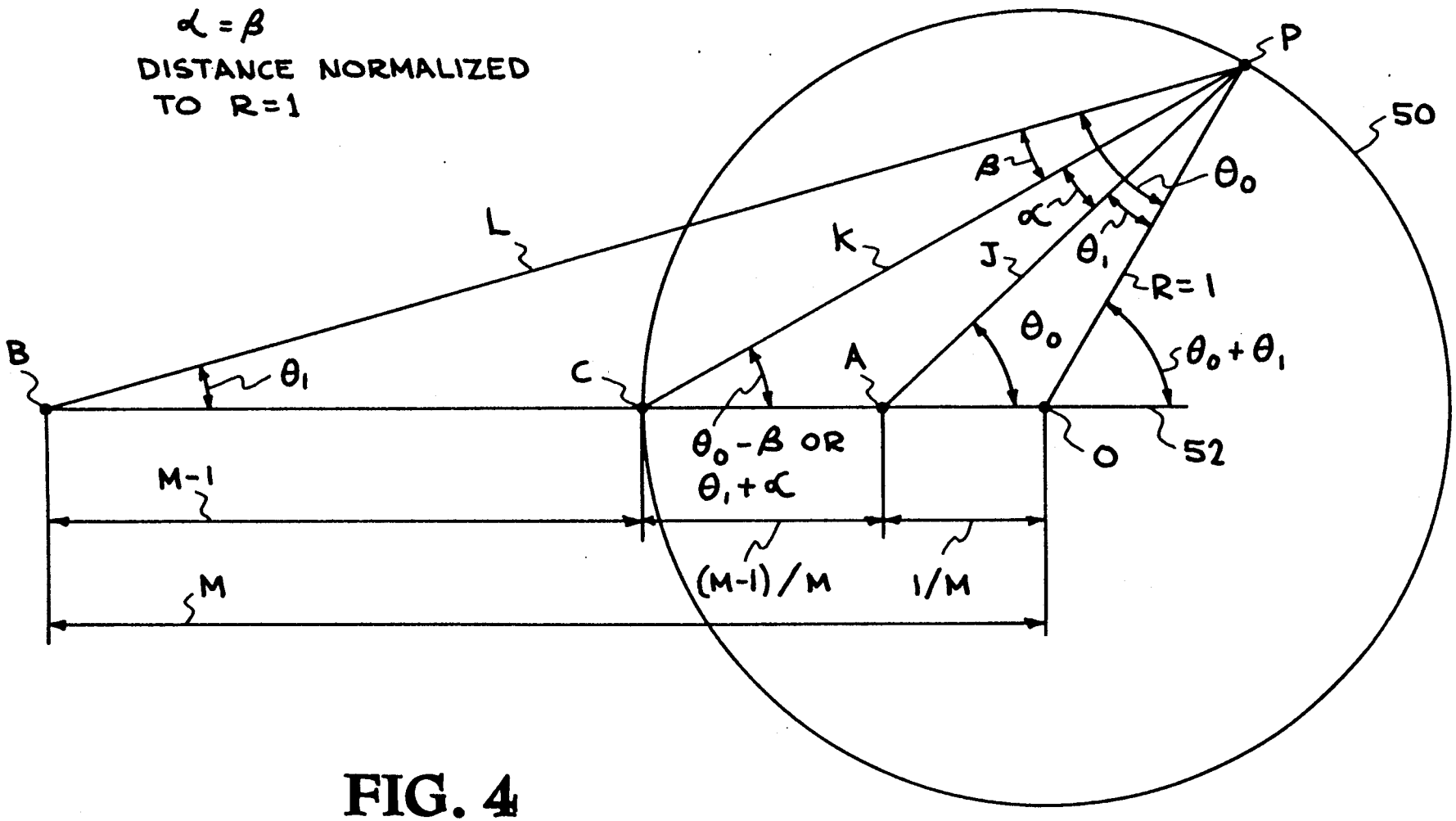
FIG. 4 is a third diagram illustrating geometry relative to an Abbe sphere, in accordance with this invention.

Reference is now made to FIG. 4, which further illustrates geometry related to an Abbe spherical surface 50. An object point A, an image point B, and a center point O of sphere 50, as described above, are shown. A point C is the point of intersection of Abbe spherical surface 50 with a geometrical axis 52 of the system. A point P is any point on the surface of the Abbe sphere 50. A radius R of sphere 50 is taken as unity to simplify the following discussion. However, the facts and relationships educed by the discussion will be of complete and unlimited generality. Thus, the distance from B to O is M, from B to C is M−1, from C to A is (M−1)/M, and from A to O is 1/M, all as shown. With respect to the point P, an angle $\theta_o$ at object point A, and an angle $\theta_I$ at image point B, as used in FIG. 1, are shown. In the following, triangles will be referred to by their corner points. Triangle AOP is similar to triangle BOP because they have a common angle at point O, and because the ratio of side BO to side PO of triangle BOP is M, and the ratio of side PO to side AO of triangle AOP is also M. Consequently, triangle BOP has the angle $\theta_o$ at point P, and triangle AOP has the angle $\theta_I$ at point P, as shown. Thus, the triangles AOP and BOP have the angle $\pi-(\theta_o+\theta_I)$ at point O. This is indicated by the angle that the line OP forms with the axis 52 being $\theta_o+\theta_I$, as shown. Lines AP, CP, and BP are set equal to J, K, and L, as shown. Also, the angle of the triangle CAP at P is set equal to $\alpha$, and the angle of triangle BCP at P is set equal to $\beta$, as shown. Therefore, the angle of triangle COP at C is either $\theta_o-\beta$, or equivalently $\theta_I+\alpha$, as shown. By direct application of the law of cosines, $$J^2=1+M^{-2}+2/M\cos(\theta_o+\theta_I), \quad (11)$$

$$K^2=2+2\cos(\theta_o+\theta_I), \quad (12)$$

and $$L^2=1+M^2+2M\cos(\theta_o+\theta_I) \quad (13)$$

Thus, by setting the sum of the angles of triangle CAP $$\pi=\alpha+(\pi-\theta_o)+(\theta_o-\beta), \quad (14)$$

or, $$\alpha=\beta. \quad (15)$$

It is further clear from triangle BAP of FIG. 4 that $$\alpha=\beta=(\theta_o-\theta_I)/2. \quad (16)$$

Alternatively, by direct application of the law of sines to triangles CAP and BCP of FIG. 4, $$M\sin\alpha/(M-1)=\sin\theta_o/K, \quad (17)$$

and, $$\sin\beta/(M-1)=\sin\theta_I/K, \quad (18)$$

respectively. Combining equations (17) and (18) to eliminate the factor (M−1)/K, provides $$\sin\alpha/\sin\beta=\sin\theta_o/M\sin\theta_I. \quad (19)$$

However, since from equations (1) and (2) the Abbe sine condition may be expressed as $$M\sin\theta_I=\sin\theta_I, \quad (20)$$

it is evident that equation (19) provides a direct verification of the equality of the angles $\alpha$ and $\beta$. It is important to understand that this equality is a direct consequence of the Abbe sine condition.

Because of the equality of angles $\alpha$ and $\beta$, and since Bragg reflection is only to occur on relatively very thin surface portions of reflecting materials, connected collections of Bragg reflecting planes disposed on and nearly adjacent to the surface of an Abbe sphere, and having their Bragg reflecting planes, individually, spatially coincident with the surfaces of individual spheres of a nested series of spheres determined by commonly having their centers at the point of intersection of the system axis with the surface of the Abbe sphere, that lies between the object and the image, may be used in constructing X-ray microscopes and telescopes in accordance with this invention. It is particularly because of this facet of the invention, and as alluded to above, that a single piece of apparatus contoured to a single Abbe sphere, in accordance with this invention, makes possible the production of X-ray images of a wide variety of different magnifications.

Figure 5:
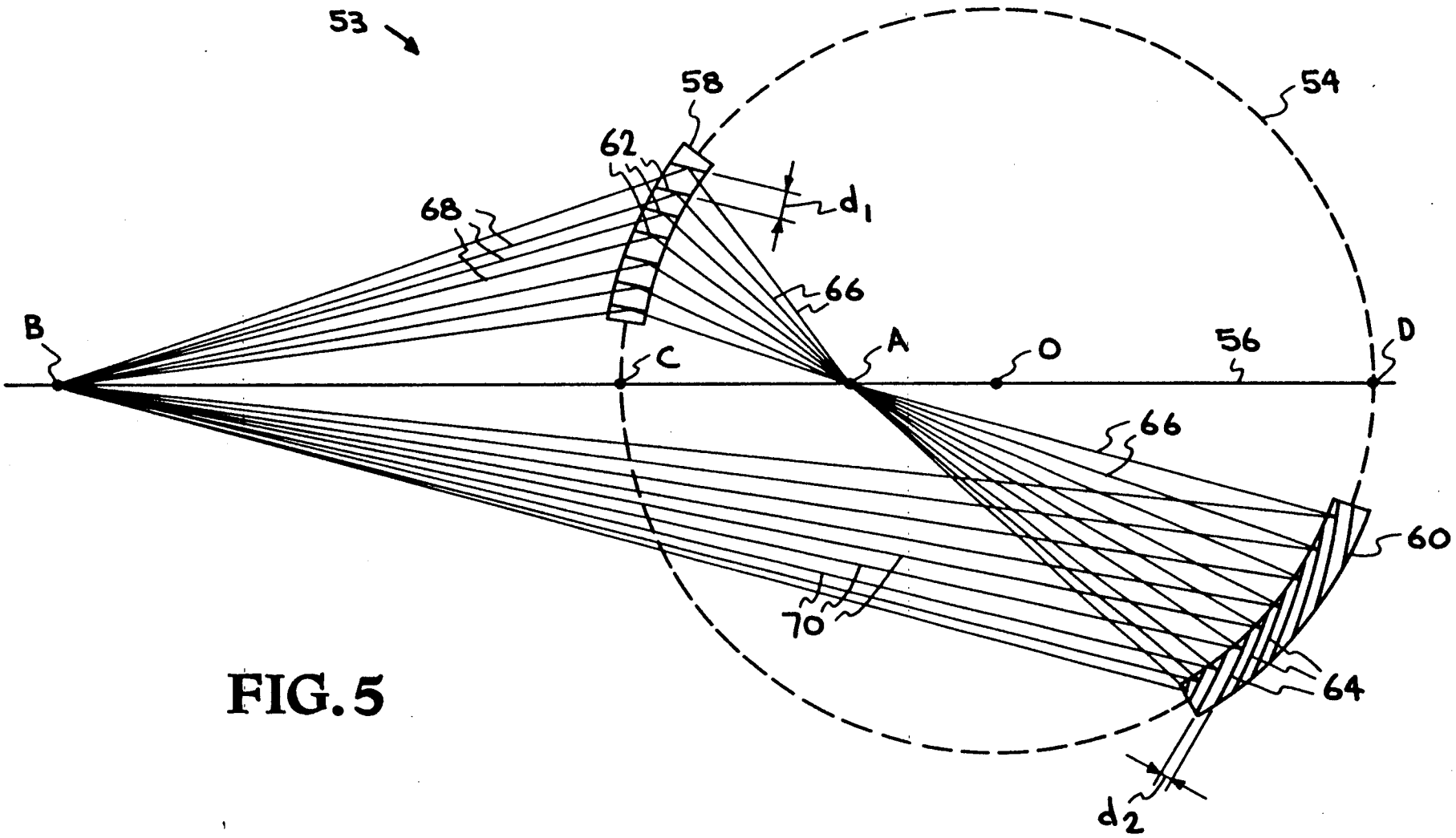
FIG. 5 is a schematic view of a first embodiment of an apparatus, made in accordance with the invention.

Reference is now made to FIG. 5, which provides a view of an apparatus, 53, in accordance with this invention. An object point A, an image point B, a surface of an Abbe sphere 54 centered on a point O, and a system axis 56, all generally as described above, are shown. The Abbe sphere surface 54 intersects axis 56, between points A and B, at point C. A first, 58, and a second, 60, collection of Bragg reflecting planes are disposed on and adjacent to the locus determined by the Abbe spherical surface 54. Collections of Bragg reflecting planes 58 and 60 may preferably be comprised of a crystal or a synthetic multilayer structure. Collection 58 is comprised of individual Bragg reflecting planes 62, and collection 60 is comprised of individual Bragg reflecting planes 64, as shown. Preferably, Bragg reflecting planes 62, and, equivalently, Bragg reflecting planes 64, are either spatially coincident with the surfaces of individual prolate ellipsoids of revolution of the nested series having foci at the points A and B, or with the surfaces of individual spherical surfaces of the nested series having their center at the point C. Planes 62 may be coincident with prolate ellipsoids of revolution, with planes 64 being coincident with spherical surfaces, and vice versa. Radiation, particularly X-radiation, leaving object point A is represented by a multiplicity of lines, or rays, 66. This radiation is Bragg reflected from collection 58 as lines, or rays, 68, and from collection 60 as lines, or rays, 70. This radiation is sharply and chromatically imaged at B. The spacing between the Bragg reflecting planes 62 is a constant $d_1$, and the spacing between the Bragg reflecting planes 64 is a constant $d_2$, as shown. Spacing constants $d_1$ and $d_2$ may, or may not, be equal. It is clear from FIG. 5 that the angle of incidence of radiation from the object point A, upon the Bragg planes 62 and 64, widely varies. In fact, it can vary over the range from zero to $\pi/2$. Therefore, since the wavelength of Bragg reflected radiation is equal to $\{2d \sin [(\pi/2)-\alpha]\}/n$, or $(2d \cos \alpha)/n$, where d is the distance between Bragg planes, n is the diffraction order, and $\alpha$ is as defined above in relation to the discussion of FIG. 4, any image formed at B will be chromatic, that is, comprised of a bandwidth of wavelengths. It is preferred that when crystals, especially natural crystals, are used in this invention, they be heated, bent and machined into their desired configuration, by techniques that are generally known in the spectroscopic, and related, arts. That is, the crystals may be bent so that their Bragg reflecting planes coincide with concentric spherical surfaces centered at the point C, and then machined or ground for removal of crystal material not disposed on and adjacent to the surface locus of their Abbe sphere. Since Bragg reflection occurs at relatively shallow angles in the embodiment of this invention typified by the collection of Bragg reflecting planes 58, this embodiment, particularly, may be used to form very high energy X-ray images. It is particularly pointed out that for rectangular Bravais lattices the (020) as well as the (002) plane are normal to the (200) plane, and therefore may be used for the Bragg reflecting planes 62 of FIG. 5. To explain, the collection of Bragg reflecting planes 58 may be fabricated by bending a cubic crystal such as LiF or Al so that its (200) planes coincide with concentric spherical surfaces centered at a point D, that is the point of intersection of the Abbe sphere surface 54 and axis 56, diametrically across the Abbe sphere surface 54 from the point C, as shown in FIG. 5. Crystal material not disposed on and adjacent to Abbe surface 54 is machined or ground away. Then, since from any point on the Abbe surface 54, the angle between lines drawn to the points C and D is $\pi/2$, any and all of the (0 nm) planes of the cubic crystal, which are normal to the (200) planes, will comprise the individual Bragg reflecting planes 62 of the collection 58.

Figure 6:
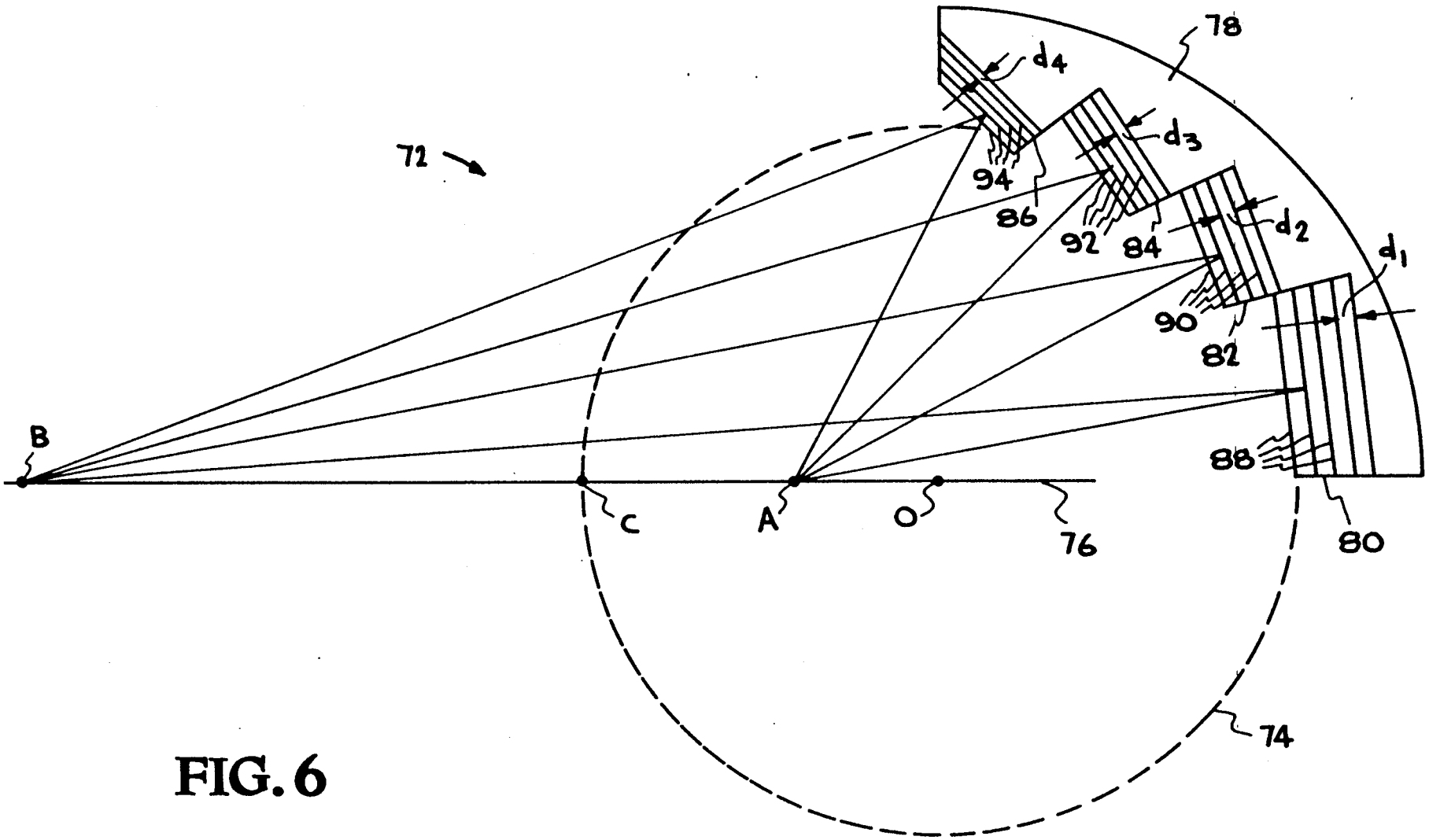
FIG. 6 is a schematic view of a second embodiment of an apparatus, made in accordance with the invention.

Reference is now made to FIG. 6, which provides a schematic view of another embodiment of an apparatus, 72, in accordance with this invention. An object point A, an image point B, a surface of an Abbe sphere 74 centered at a point O, and a system axis 76, all generally as described above, are shown. The Abbe sphere surface 74 intersects axis 76, between points A and B, at point C. A connected collection of Bragg reflecting planes comprised of a synthetic multilayer structure 78 is shown. The synthetic multilayer structure 78 is comprised of a multiplicity of step components 80, 82, 84 and 86, which are shown very much enlarged for the purpose of providing clarity of illustration. The purpose of step components 80, 82, 84 and 86 is to provide a multiplicity of individually spatially orientable groups of Bragg reflecting planes 88, 90, 92, and 94 as shown. These planes individually are either spatially coincident with the individual surfaces of the nested series of prolate ellipsoids of revolution having foci at points A and B, or with the individual surfaces of the nested series of spheres centered at C, as discussed hereinabove. The spacing of the Bragg reflecting plane groups 88, 90, 92 and 94 is $d_1$, $d_2$, $d_3$ and $d_4$, respectively, as shown. These spacings may all be equal, or they may be varied to tailor and control the wavelengths and amount of radiation Bragg reflected from synthetic multilayer structure 78. For example, since the Bragg equation, as discussed above, is $n\lambda = 2d \cos \alpha$, with $\lambda$ being H radiation wavelength, the Bragg spacings $d_1$, $d_2$, $d_3$ and $d_4$ may be individually controlled to keep the spacing, d, times cos $\alpha$ value approximately constant. This will cause the synthetic multilayer structure 78 to Bragg reflect only radiation of, approximately, a single wavelength. The particular constant to which d cos $\alpha$ is held approximately fixed, will determine the single approximate wavelength reflected. The cos $\alpha$ function is fully determinable by the geometric relationships disclosed hereinabove. In other situations, $d_1$, $d_2$, $d_3$ and $d_4$ may be individually controlled, for example, to avoid the reflection of certain wavelengths, and so forth. Synthetic microstructures such as the multilayer structure 78 may be constructed by methods and techniques presently known and used in the engineering and scientific arts. In particular, it is known how to construct synthetic microstructures wherein the microstructure layer spacing is variable. It is emphasized that in practice a great many step components, such as step components 80, 82, 84 and 86, will be utilized so that their Bragg reflecting planes, such as planes 88, 90, 92 and 94, will be disposed on and adjacent to the locus defined by the surface of an Abbe sphere, such as surface 74.

Figure 7:
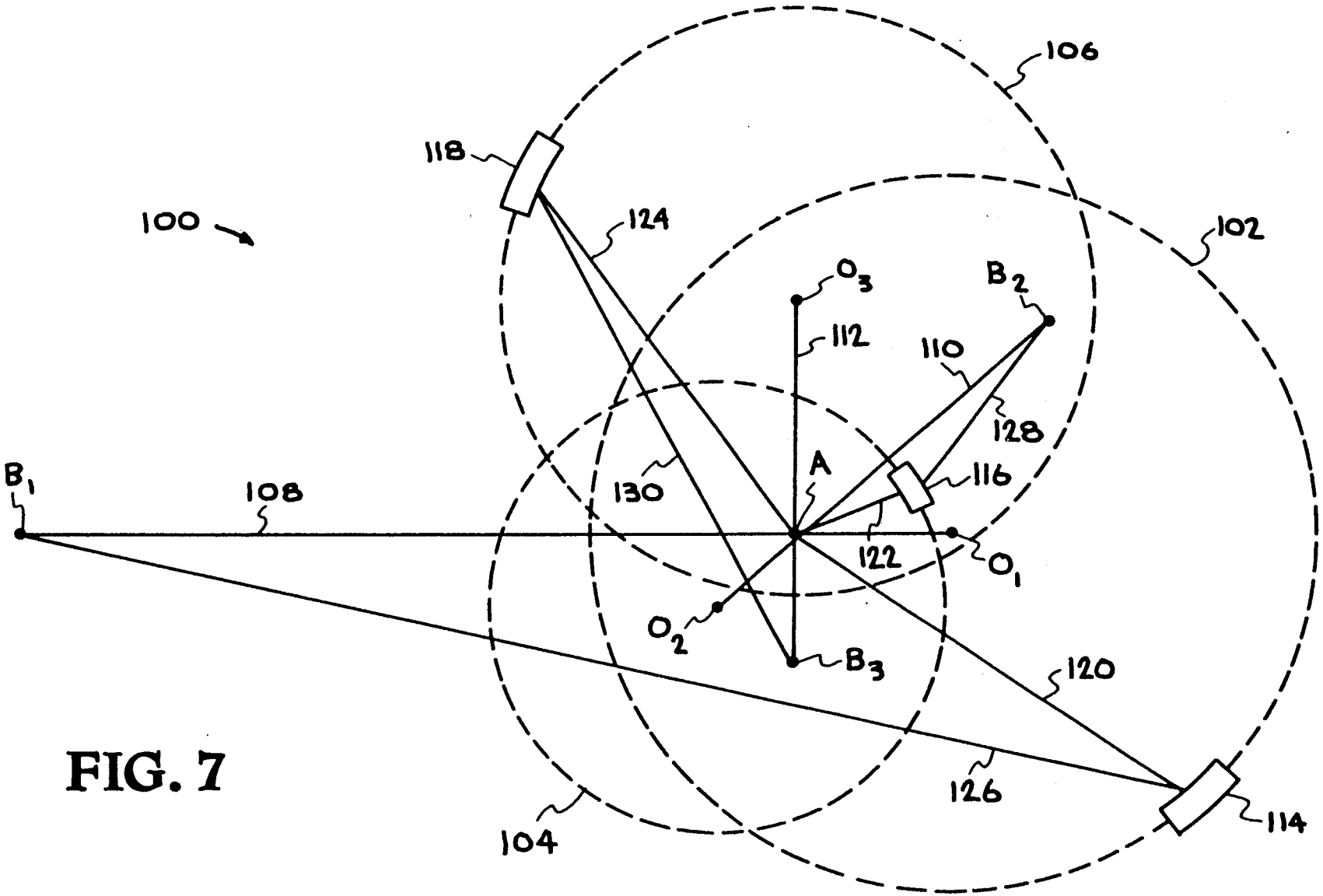
FIG. 7 is a schematic view of a multiplicity of apparatuses, all made in accordance with this invention, and all functioning with respect to a single X-ray emitting object.

In practice, multiple connected collections of Bragg reflecting planes related to the same or multiple Abbe spheres of different radii and center positions, as described herein, may be simultaneously utilized to produce a multiplicity of X-ray images, including hard X-ray images, of various magnifications, chromatic contents, and spatial locations. Also, in practice, and even though the disclosed structures of this invention are indeed symmetric about their system axes, these structures need not extend completely about those axes, and thus may be constructed leaving room for other apparatuses, as required. This is made clear by reference to FIG. 7, which provides a schematic view of multiple X-ray apparatuses, 100, in accordance with this invention, and all disposed to function with respect to a single X-ray emitting object. An object point A, a set of three image points $B_1$, $B_2$ and $B_3$, a set of three related Abbe spheres 102, 104 and 106, centered at points $O_1$, $O_2$ and $O_3$, respectively, and a set of three related system axes 108, 110, 112, all as individually and generally described above, are shown. Three connected collections of Bragg reflecting planes 114, 116 and 118, as described above, and related to the Abbe spheres 102, 104 and 106, respectively, are shown. Radiation including X-rays, typified by a set of three lines 120, 122 and 124, propagates from the image point A to the connected collections of Bragg reflecting planes 114, 116 and 118, respectively, is Bragg reflected, and proceeds thence to the points $B_1$, $B_2$ and $B_3$, respectively, along paths typified by three lines 126, 128 and 130, where sharp chromatic X-ray images are formed in accordance with the principles of this invention. FIG. 7 is thus intended to indicate the broad range of experimental capability provided by this invention.

It is thus appreciated that in accordance with the invention as herein described and shown in FIGS. 1 to 7, method and apparatus which do not rely on internal total reflection at small grazing angle optical techniques, for producing sharp, extended, magnified chromatic X-ray images of extended X-ray emitting objects, are provided.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A method for producing a sharp chromatic image, from radiation within an X-ray bandwidth, of a portion of an object plane extending from a point A on the object plane, upon a portion of an image plane extending from a point B on the image plane, with B being a conjugate point of A, with the points A and B being upon and thereby defining a system axis, with the object plane and the image plane each being perpendicular to the system axis, and with the sharp image having a magnification M, the method comprising the steps of:

directing radiation, within the X-ray bandwidth, propagating from the portion of the object plane extending from the point a, onto a connected collection of Bragg reflecting planes disposed on and adjacent to a locus determined by a spherical surface of radius R, with R being equal to $MS/M^2-1)$, with S being the distance between the points A and B and being positive when M is greater than unity and negative when M is less than unity, with the spherical surface being centered on the system axis, and with the point A being positioned a distance R/M from the center of the spherical surface and with the point B being positioned a distance MR from the center of the spherical surface; and spatially orienting the Bragg reflecting planes to Bragg reflect radiation, within the X-ray bandwidth, propagating from the portion of the object plane extending from the point a toward the portion of the image plane extending from the point B.

2. A method as recited in claim 1, wherein the spatially orienting step is carried out by making the Bragg reflecting planes individually spatially coincident with the surfaces of individual prolate ellipsoids of revolution of a nested series of prolate ellipsoids of revolution, with the nested series of prolate ellipsoids of revolution being determined by commonly having their foci at the points A and B.

3. A method as recited in claim 1, wherein the spatially orienting step is carried out by making the Bragg reflecting planes individually spatially coincident with the surfaces of individual spheres of a nested series of spheres, with the nested series of spheres being determined by commonly having their centers at the point of intersection, that lies between the points A and B, of the system axis with the spherical surface of radius R.

4. A method as recited in claim 2, wherein the spacing distance between adjacent Bragg reflecting planes is a constant.

5. A method as recited in claim 3, wherein the spacing distance between adjacent Bragg reflecting planes is a constant.

6. A method as recited in claim 2, wherein the spacing distance between adjacent Bragg reflecting planes is tailored to control the wavelengths and the amount of the radiation Bragg reflected from the connected collection of Bragg reflecting planes.

7. A method as recited in claim 3, wherein the spacing distance between adjacent Bragg reflecting planes is tailored to control the wavelengths and the amount of the radiation Bragg reflected from the connected collection of Bragg reflecting planes.

8. A method as recited in claim 1, wherein the connected collection of Bragg reflecting planes is comprised of a crystal, and wherein the spatially orienting step is performed by heating, bending and machining the crystal.

9. A method as recited in claim 1, wherein the connected collection of Bragg reflecting planes is comprised of a synthetic multilayer structure.

10. A method as recited in claim 7, wherein the connected collection of Bragg reflecting planes is comprised of a synthetic multilayer structure.

11. A method for producing a sharp chromatic image, from radiation within a multiplicity of X-ray bandwidths, of a portion of an object plane extending from a point A on the object plane, upon a portion of an image plane extending from a point B on the image plane, with B being a conjugate point of A, with the points A and B being upon and thereby defining a system axis, with the object plane and the image plane each being perpendicular to the system axis, and with the sharp image having a magnification M, the method comprising the steps of:

directing radiation, within the multiplicity of X-ray bandwidths, propagating from the portion of the object plane extending from the point A, only a multiplicity of connected collections of Bragg reflecting planes disposed, at different locations, on and adjacent to a locus determined by a spherical surface of radius R, with R being equal to $MS/M^2-1)$, with S being the distance between the points A and B and being positive when M is greater than unity and negative when M is less than unity, with the spherical surface being centered on the system axis, with the point A being positioned a distance R/M from the center of the spherical surface and with the point B being positioned a distance MR from the center of the spherical surface; and spatially orienting, individually, the Bragg reflecting planes of each connected collection of Bragg reflecting planes, of the multiplicity of connected collections of Bragg reflecting planes, to Bragg reflect radiation, within an individual X-ray bandwidth, of the multiplicity of X-ray bandwidths, propagating from the portion of the object plane extending from the point A toward the portion of the image plane extending from the point B.

12. A method as recited in claim 11, wherein the spatially orienting step is carried out by making the Bragg reflecting planes individually spatially coincident with the surfaces of individual prolate ellipsoids of revolution of a nested series of prolate ellipsoids of revolution, with the nested series of prolate ellipsoids of revolution being determined by commonly having their foci at the points A and B.

13. A method as recited in claim 11, wherein the spatially orienting step is carried out by making the Bragg reflecting planes individually spatially coincident with the surfaces of individual spheres of a nested series of spheres, with the nested series of spheres being determined by commonly having their centers at the point of intersection, that lies between the points A and B, of the system axis with the spherical surface of radius R.

14. A method as recited in claim 11, wherein the spatially orienting step is carried out by making the Bragg reflecting planes, of a first portion of the connected collections of Bragg reflecting planes, individually spatially coincident with the surfaces of individual prolate ellipsoids of revolution of a nested series of prolate ellipsoids of revolution, with the nested series of prolate ellipsoids of revolution being determined by commonly having their foci at the points A and B, and by making the Bragg reflecting planes, of a remaining portion of the connected collections of Bragg reflecting planes, individually spatially coincident with the surfaces of individual spheres of a nested series of spheres, with the nested series of spheres being determined by commonly having their centers at the point of intersection, that lies between the points A and B, of the system axis with the spherical surface of radius R.

15. A method as recited in claim 12, wherein the spacing distance between adjacent Bragg reflecting planes, of each individual connected collection of Bragg reflecting planes, is an individual constant.

16. A method as recited in claim 13, wherein the spacing distance between adjacent Bragg reflecting planes, of each individual connected collection of Bragg reflecting planes, is an individual constant.

17. A method as recited in claim 14, wherein the spacing distance between adjacent Bragg reflecting planes, of each individual connected collection of Bragg reflecting planes, is an individual constant.

18. A method as recited in claim 12, wherein the spacing distance between adjacent Bragg reflecting planes, of each individual connected collection of Bragg reflecting planes, is tailored to control the wavelengths and the amount of the radiation Bragg reflected from the individual connected collection of Bragg reflecting planes.

19. A method as recited in claim 13, wherein the spacing distance between adjacent Bragg reflecting planes, of each individual connected collection of Bragg reflecting planes, is tailored to control the wavelengths and the amount of the radiation Bragg reflected from the individual connected collection of Bragg reflecting planes.

20. A method as recited in claim 14, wherein the spacing distance between adjacent Bragg reflecting planes, of each individual connected collection of Bragg reflecting planes, is tailored to control the wavelengths and the amount of the radiation Bragg reflected from the individual connected collection of Bragg reflecting planes.

21. A method as recited in claim 11, wherein each individual connected collection of Bragg reflecting planes is comprised of a crystal.

22. A method as recited in claim 11, wherein each individual connected collection of Bragg reflecting planes is comprised of a synthetic multilayer structure.

23. A method as recited in claim 11, wherein each individual connected collection of Bragg reflecting planes is comprised of a material selected from the group consisting of crystal and synthetic multilayer structure.

24. An apparatus that produces a sharp chromatic X-ray image, of magnification M, from radiation within an X-ray bandwidth, that propagates from an object, the apparatus comprising:

a connected collection of Bragg reflecting planes disposed on and adjacent to a locus determined by a spherical surface of radius R, with a diameter of the spherical surface being upon and determining a system axis;

wherein the Bragg reflecting planes are spatially oriented to Bragg reflect the radiation from the object, within the X-ray bandwidth, that propagates from a region extending from a point A, located on the system axis a distance R/M from the center of the spherical surface, toward a region extending from a point B, located on the system axis a distance MR from the center of the spherical surface, with the points A and B both being on a same side of the system axis that extends outward from the center of the spherical surface; and whereby the sharp chromatic X-ray image of a portion of an object plane extending from the point A is produced upon a portion of an image plane extending from the point B.

25. An apparatus, as recited in claim 24, wherein the Bragg reflecting planes are, individually, spatially coincident with the surfaces of individual prolate ellipsoids of revolution of a nested series of prolate ellipsoids of revolution, with the nested series of prolate ellipsoids of revolution being determined by commonly having their foci at the points A and B.

26. An apparatus, as recited in claim 24, wherein the Bragg reflecting planes are, individually, spatially coincident with the surfaces of individual spheres of a nested series of spheres, with the nested series of spheres being determined by commonly having their centers at the point of intersection, that lies between the points A and B, of the system axis with the spherical surface of radius R.

27. An apparatus, as recited in claim 25, wherein the spacing distance between adjacent Bragg reflecting planes is a constant.

28. An apparatus, as recited in claim 26, wherein the spacing distance between adjacent Bragg reflecting planes is a constant.

29. An apparatus, as recited in claim 25, wherein the spacing distance between adjacent Bragg reflecting planes is tailored to control the wavelengths and the amount of the radiation Bragg reflected from the connected collection of Bragg reflecting planes.

30. An apparatus, as recited in claim 26, wherein the spacing distance between adjacent Bragg reflecting planes is tailored to control the wavelengths and the amount of the radiation Bragg reflected from the connected collection of Bragg reflecting planes.

31. An apparatus, as recited in claim 24, wherein the connected collection of Bragg reflecting planes is comprised of a crystal.

32. An apparatus, as recited in claim 24, wherein the connected collection of Bragg reflecting planes is comprised of a synthetic multilayer structure.

33. An apparatus, as recited in claim 29, wherein the connected collection of Bragg reflecting planes is comprised of a synthetic multilayer structure.

* * * * *